United States Patent [19]

Winings

[11] 4,239,567

[45] Dec. 16, 1980

[54] REMOVABLY HOLDING PLANAR ARTICLES FOR POLISHING OPERATIONS

[75] Inventor: Richard H. Winings, Berks County, Pa.

[73] Assignee: Western Electric Company, Inc., New York, N.Y.

[21] Appl. No.: 951,810

[22] Filed: Oct. 16, 1978

[51] Int. Cl.[3] ..... B32B 31/00

[52] U.S. Cl. ..... 156/154; 51/216 LP; 51/216 T; 51/237 R; 156/247; 156/299; 156/308.6; 156/344

[58] Field of Search ..... 156/154, 153, 155, 299, 156/247, 316, 307, 344, 308, 308.6; 252/79.1, 356; 428/78, 420, 320, 408; 427/302, 400, 399, 407 R; 51/216 T, 237 R, 216 LP; 562/584; 106/287.23

[56] References Cited

U.S. PATENT DOCUMENTS

| | | | |
|---|---|---|---|
| 2,597,721 | 5/1952 | Goebel et al. | 156/308 |
| 2,699,633 | 1/1955 | Lapenas | 51/216 LP |
| 3,287,197 | 11/1966 | Errede | 156/308 |
| 3,449,870 | 6/1969 | Jenson | 51/216 LP |
| 3,453,783 | 7/1969 | Queen | 51/237 R |
| 3,561,995 | 2/1971 | Wu et al. | 428/409 |
| 3,841,031 | 10/1974 | Walsh | 51/283 |
| 4,132,037 | 1/1979 | Bonora | 51/216 LP |

OTHER PUBLICATIONS

Stevens, "Surfactants", Kirk-Othmer ect., vol. 19, pp. 507-593, ©1969.

Hackh's Chemical Dictionary, 4th Edition, p. 650.

*Primary Examiner*—John J. Gallagher

*Attorney, Agent, or Firm*—D. C. Watson; W. O. Schellin

[57] ABSTRACT

PLanar articles such as silicon wafers 40 are removably mounted onto a flat microcellular polyurethane surface layer 48 of a carrier 30 to permit an exposed surface 42 of each wafer 40 to be polished.

To retain the wafers 40 against lateral polishing forces on the carrier 30 the surface of the layer 48 is treated with a dilute organic acid prior to mounting the wafers 40. The treatment involves contacting the surface of the layer 48 with the acid selected from the group consisting of citric, propionic, formic and acetic acids. The surface of the layer 48 is thoroughly wetted with the acid after which all excess acid is scraped from the surface. The wafers 40 are then manually placed upon the surface while it is still wet.

12 Claims, 3 Drawing Figures

FIG.- 2
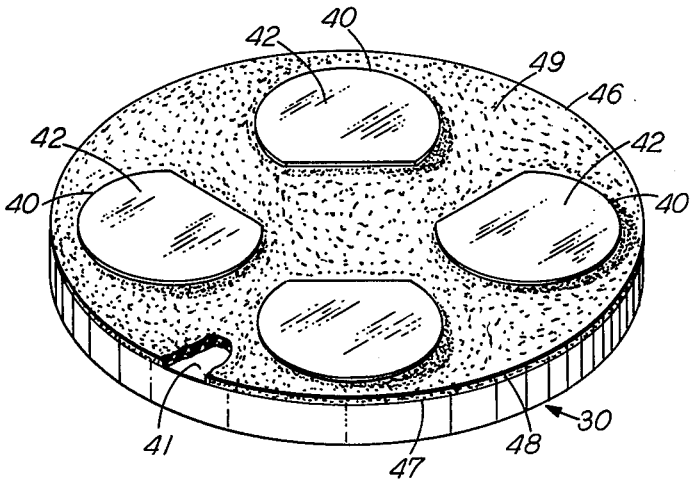
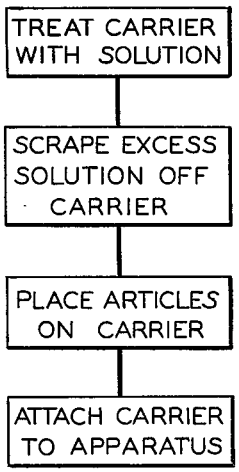
FIG.- 3

REMOVABLY HOLDING PLANAR ARTICLES FOR POLISHING OPERATIONS

TECHNICAL FIELD

This invention relates to methods of removably mounting and holding planar articles on a sheet to permit them to resist shear forces directed against such articles. More particularly, this invention relates to methods of removably mounting and holding wafers on a carrier prior to polishing the wafers. The invention further relates to methods of activating the mounting surface of the carrier to enhance its adhesive properties.

BACKGROUND OF THE INVENTION

The invention is described hereunder with respect to polishing semiconductor wafers. In preparing such wafers for the various masking, doping and diffusion steps used in the manufacture of semiconductor devices, each wafer is polished on one of its two major surfaces to a highly reflective and extremely flat surface condition. Conventional semiconductor forming steps are subsequently applied to the polished surface. Experience has shown that any imperfections greater than 0.5 mils (thousandths of an inch) and in some cases even as small as 0.2 mils from a flat plane may cause finished semiconductor devices to be defective. It is, therefore, desirable to polish the "active" side or "frontside" of the wafer to a flatness having no more than about 0.2 to 0.5 mils nonlinear thickness variation (NTV) from a perfect plane. The reverse or "backside" of the wafer typically receives no polishing treatment.

Various polishing machines are commercially available which can be used to polish the wafers to the required flatness. These machines use one or more wafer carriers. A wafer carrier provides a flat circular surface to which one or more wafers are removably mounted. The carrier is then inverted upon and forced against a rotatable turntable. The turntable provides a flat polishing surface which is powered to move with respect to the wafers on the carrier. The carrier also rotates. Some types of polishing machines use an additional translational movement of the carrier back and forth across the rotating turntable to enhance the randomness of the polishing motion.

The relative movement between the rotating polishing surface of the turntable and the rotating carrier under a given force or pressure between them polishes the wafers. Abrasive or chemical slurries are added to sustain the polishing action on the wafers. Water may be added for cooling and for cleaning the wafers.

A continuous problem in polishing wafers has been to mount the wafers on the carriers to retain them securely against lateral or shear forces generated by the movement of the polishing surface against the wafers. The wafers must be mounted perfectly flat without introducing a bending stress. If such a stress does exist after the wafer is mounted and the wafer is polished flat, a release of the wafer from the carrier relieves the stress and introduces a new surface deviation into the polished surface of the wafer, thereby destroying its flatness.

Prior art techniques of mounting the wafers to the carrier by a film of wax tend to introduce such surface deviations or waviness in polished wafers, especially in presently preferred, larger diameter wafers. Such prior art wax mounting techniques also tend to leave wax residues on the wafers. The removal of such residues from the wafers is cumbersome and costly.

In seeking alternatives to wax mounting techniques, various types of tacky layers have been used to cover the carrier for mounting the wafers. Soft layers also tend to introduce a waviness into the wafers. Harder layers as, for instance, cellular polyurethane films do not offer sufficient lateral restraint to retain the wafers securely while they are being polished. Such harder layers have, however, been used together with lateral mechanical restraints.

The mechanical restraints tend to introduce problems as well. Pin restraints may chip the edges of the wafers. Wafer pockets provided by templates may accumulate slurries which can affect the ultimate flatness of the wafer. While mechanical lateral restraints are commonly used with presently known polishing techniques, their use requires a great deal of caution.

A composite sheet of a layered structure is commercially available as a mounting surface for the wafers. The sheet has a fibrous resiliently compressible underlayer and a relatively hard but flexible microcellular top layer. The top layer is of polyurethane. One such sheet is sold by the George Newman Co. under the designation FP-5G.

When the sheet is attached to the carrier and the sheet is wetted, wafers are pressure-mounted to the sheet. The wafers are then polished in the described manner without any further lateral restraint on the wafers. However, for the sheet to retain its initial mounting characteristics, it appears that it has to be roughened after being used and that the wafers have to be mounted with a relatively large mounting force. Applying such a mounting force is undesirable. It may damage the wafers and can introduce into the wafers the undesirable stresses which cause waviness in the polished wafers. It is, therefore, highly desirable to improve the mounting characteristics of such a sheet to permit the wafers to be mounted thereto without exerting a large mounting force to press the wafers against the sheet.

SUMMARY OF THE INVENTION

Accordingly, it is an object of this invention to provide improved methods of removably mounting planar articles on a sheet to permit them to resist shear forces directed against such articles.

With this and other objects in view, the present invention contemplates treating a mounting surface in such a way as to promote adhesion between the surface and the articles. For example, treating the mounting surface with an organic acid selected from the group consisting of citric, propionic, formic and acetic acids has been found to activate the surface. It is theorized that the activation treatment promotes hydrogen bonding between the surface of the sheet and the articles to be mounted.

In one particular embodiment of the invention, these organic acids can be used to treat a mounting surface comprising a microcellular polyurethane material. After the activation treatment, the articles are positioned on the activated surface.

In a specific embodiment of the invention, the substrate includes a solid support to which a composite sheet material is bonded. The composite sheet material comprises a fibrous matrix of polyester and a microcellular polyurethane material having an exposed surface on which the articles are to be mounted. The surface is treated with an aqueous solution of acetic acid. An advantageous concentration lies in the range between 2 to 30 percent by weight of acetic acid.

BRIEF DESCRIPTION OF THE DRAWING

Other objects and features of the invention will be more readily understood from the following detailed description thereof, when read in conjunction with the accompanying drawing, wherein:

FIG. 2 is a pictorial view of an inverted carrier showing a cluster of wafers in accordance with the present invention; and FIG. 3 is a flow diagram of steps for mounting articles such as the wafers of FIG. 2, in accordance with the present invention.

DETAILED DESCRIPTION

The Wafer Polishing Apparatus

Figure 1:
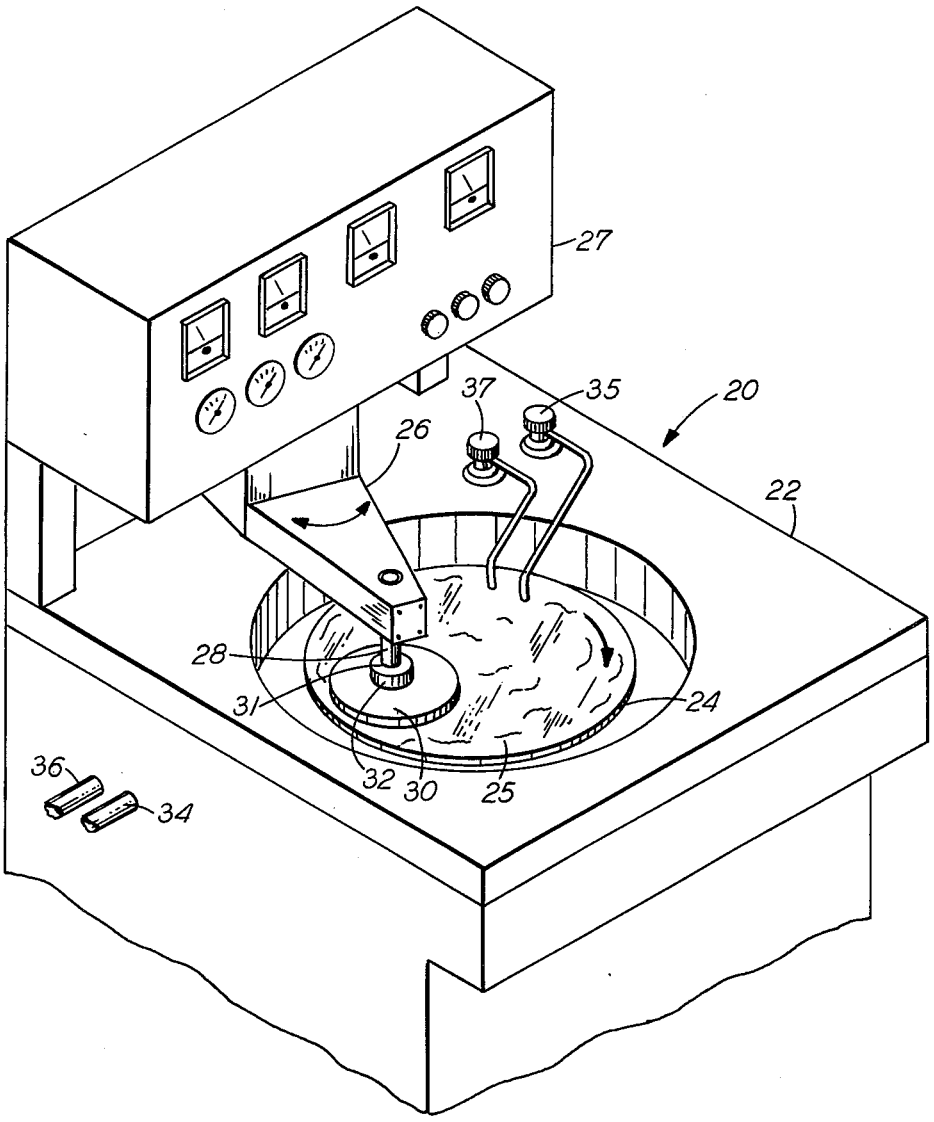
FIG. 1 is a pictorial view of a typical polishing apparatus to which the invention is advantageously applied.

Referring to FIG. 1, a typical wafer polishing apparatus, designated generally by the numeral 20, is depicted pictorially. Such a polishing apparatus 20 is generally known and is sold, for example, by R. Howard Strasbaugh, Inc., of Long Beach, California. A general description of the apparatus 20 and of its function may be helpful in understanding the invention, inasmuch as the invention is advantageously used in conjunction with the apparatus 20.

A base 22 supports a rotatable turntable or platen 24. The platen is driven by a motor (not shown) to rotate in a particular direction, for example in a clockwise direction, as shown by an arrow. A flat top surface of the platen 24 is covered by a polishing pad 25. The pad 25 is usually bonded to the platen 24. An arm 26 is pivotally mounted to an overhead control console 27 to permit the arm 26 to oscillate back and forth in a horizontal plane. At its outer end, the arm 26 supports a vertical spindle 28. Through the arm 26 the spindle 28 can be raised and lowered with respect to the platen 24. When the spindle 28 is raised, a wafer carrier 30 can be removed from and re-attached to a lower end 31 of the spindle 28. The carrier 30, when attached to the lower end 31, can be pivoted universally through a small angle with respect to the spindle 28. The pivotal attachment of the carrier 30 to the lower end is housed in a center hub 32 of the carrier 30. In a number of sequential polishing operations or cycles, two of the carriers 30 may be used alternately and exchanged after each such polishing cycle.

After being attached to the spindle 28, the carrier 30 is pressed against the surface of the polishing pad 25 of the platen 24. The capability of the carrier 30 to pivot with respect to the spindle 28 permits a pressure between the pad 25 and the carrier 30 to become evenly distributed. When the platen 24 rotates, the carrier 30 tends to rotate of its own accord in the same direction as the platen 24. Throughout the polishing cycle, the arm 26 slowly oscillates the spindle 28 and with it the carrier 30 back and forth over a radial path toward and away from the center of the platen 24.

A pipe 34 supplies water through valve 35 to the surface of the polishing pad 25. The water is used to preferably maintain the temperature of the polishing pad 25 below 50° C. and to clean all surfaces after each cycle.

A pipe 36 similarly supplies a polishing slurry of a type well known in the art through a valve 37 to the pad 25. The slurry disperses about the pad 25 through centrifugal forces caused by the rotation of the platen 24 and by engagement of wafers 40 (See FIG. 2.) mounted to an underside 41 of the carrier 30, as the carrier 30 pushes the wafers 40 into contact with the pad 25 and with the slurry thereon. Friction and possibly a chemical reaction remove material from the frontside surfaces 42 of the wafers 40, and polish the surfaces 42 of the wafers 40 to a desired smoothness, flatness and to a desired thickness.

Material is generally removed from the wafers 40 at a rate of from 0.06 to 0.10 mils (thousandths of an inch) per minute. The rate at which the material is removed depends, of course, on several factors. Generally the rate of removal depends on frictional forces exerted on the wafers 40 and on the temperature of the wafers 40 at which polishing takes place. The temperature of the wafers 40 also tends to affect the speed of any chemical reaction which may further the polishing action on the wafers 40. The temperature of the wafers 40, of course, is controlled by the mechanical friction forces against the wafers 40 and by the amount of cooling water introduced during the polishing cycle. The mechanical friction forces in turn are the result of (1) the coefficient of friction of the polishing pad 25 and the slurry on the surfaces 42, and (2) the normal force or pressure with which the wafers 40 are pushed against the pad 25.

After having been polished, the wafers 40 are rinsed and then cleaned in a dilute solution of hydrogen peroxide. The carrier 30 is also carefully cleaned of particulate matter. Such particulate matter, if it accumulates on wafer backside surfaces, can cause pressure which may be transmitted through the wafers to cause unwanted waviness in the wafer after polishing.

Referring again to FIG. 2, there is shown the underside 41 of the carrier 30 with the wafers 40 removably mounted. The term "removably mounted" refers to a temporary holding of the wafers to the underside 41 of the carrier 30. The wafers 40 are preferably placed on the underside 41, while the carrier 30 is removed from the apparatus 20 and temporarily held in an inverted position, as shown in FIG. 2. The inverted position provides visual as well as physical access to the underside 41. The wafers 40 are preferably evenly placed in a circular pattern on the underside 41. The exact number of the wafers 40 which are placed on the carrier 30 depends on the relative size of the carrier 30 and of the wafers 40.

To hold the wafers 40 in place on the underside 41 of the carrier 30, a composite sheet 46 of material is attached to a flat surface 41 of the carrier 30. The sheet 46 includes a base matrix 47 of polyester fibers held together by a microcellular polyurethane foam surface layer 48. A top surface 49 of the layer 48 is substantially flat and is smooth in appearance. The microcellular nature of layer 48 locally accommodates particulate matter and small surface imperfections on backside surfaces of the wafers 40. The wafers 40, when placed into contact with the surface 49 of the layer 48 are substantially uniformly supported by the layer 48.

The wafers 40 are normally adhered to the surface 49 by treating the surface 49 with water and then pressing the wafers onto the surface 49. The wafers 40 mounted in this manner can usually be polished without lateral mechanical restraints. However, unless the surface 49 of the sheet 46 is roughened after each polishing cycle and unless the wafers are engaged with the sheet 46 with a pressing force, the sheet 46 will not retain the wafers 40 against shear forces during polishing after three polishing cycles. During any further polishing cycles, the wafers 40 have a tendency to break loose as a result of the shear forces to which the wafers 40 are subjected during the polishing operation. The wafers 40, of course, become damaged or destroyed if they do break loose.

It has now been found, that through a relatively simple preparation of the carrier 30 and in particular of the sheet 46, between polishing cycles, the useful life of the sheet 46 is improved. The useful life is the number of times the wafers 40 can be mounted and successfully polished without introducing waviness into the polished wafers.

When the sheet 46, particularly its surface 49 is, for example, exposed to or contacted by a water-diluted acetic acid, the sheet may be used through approximately 40 cycles and possibly through as many as 80 cycles before it is replaced by a new and unused sheet 46 of the same material.

The replacement of the sheet 46 involves physically tearing the sheet from the carrier 30, cleaning the underlying surface of cement residues, and preparing the surface of the carrier 30 for the new sheet 46. Each new sheet 46 is bonded by a commercially available contact cement, such as Formica 100 cement. An extension of the useful life of the sheet 46 minimizes, of course, the replacement costs of the sheet 46.

The useful life of the sheet 46 ends when a depression or set develops in the sheet 46 in an area where the wafers 40 are placed for polishing, and the surface of the set becomes wavy to introduce stresses in the wafers 40. When these stresses result in waviness on the polished wafers beyond a predetermined limit, the sheet 46 is replaced.

One theory is that the treatment of the sheet 46 promotes what is known as "hydrogen bonding" between the wafers 40 and the surface 49 of the sheet 46. For example, an exposure of the sheet 46 to acetic acid diluted with water in a range between 2 to 30 percent by weight has resulted in the advantageous phenomenon of securely adhering the wafers 40 to the surface 49 with dependability.

The acid can be applied in any number of ways as long as dust, lint, fibers and other foreign substances are excluded from the surface to be activated. It can be rubbed, brushed, sprayed or splashed upon the surface to be activated. A convenient way to apply the acid is to cover the bottom of a plastic tray with a lint-free absorbent paper. Then enough of the dilute acetic acid is poured upon the paper to wet it thoroughly.

A carrier 30 is then inverted directly upon the wet paper and the mounting surface 49 of the sheet 46 becomes thoroughly wetted or soaked with acid. Normally it is sufficient to let the soaking take place for the time it takes for a polishing cycle to be completed. However, care should be exercised to see that the entire mounting surface 49 is soaked with acid. Typically a period of time from about 1 to about 6 minutes is required to soak the surface 49 thoroughly.

Preferably the surface 49 of the sheet is then cleared of excess moisture by scraping the surface 49 under moderate manually applied pressure with a stainless steel blade. Advantageously the surface 49 should not be allowed to dry before the wafers are placed thereon. When treated in the described manner, the surface 49 has become activated to an extent that manually placing the wafers 40 on the still wet surface 49 causes the wafers to adhere securely to permit the carrier 30 to be attached to the spindle 28 of the apparatus 20.

It should be noted, though, that before the polishing operation begins the carrier 30 is lowered with a predetermined force or pressure against the platen 24. The force exerted by the platen 24 against wafers 40 increases the friction force which mounts the wafers 40 to the carrier 30 to resist the shear forces during the polishing operation.

However, the force exerted by the platen 24 does not produce flatness deviations on the wafers 40 which are greater than the stated limits; yet the wafers 40 remain mounted to the carrier 30 throughout the useful life of the sheet 46. After each wafer 40 is polished, said wafer is demounted from the sheet 46 by applying a force to the wafer 40 in a direction normal to and away from the sheet 46.

A presently preferred material for the sheet 46, the holding forces of which are advantageously improved by the present methods, is sold by George Newman and Company of Biddeford, Maine, under the trade designation FP-5G.

The FP-5G sheet which has been used is typically 1/16 of an inch thick and has the described base matrix 47 to which the microcellular polyurethane surface layer 48 is bonded. It is expected that other sheets of similar composition and/or structure can be effectively activated by methods in accordance with this invention.

In a broader practice of the invention, treating the surface layer 48 has been extended to the use of other solutions for such a treatment. Since the use of the sheet 46 without the presently disclosed treatment was limited to three polishing cycles, demonstrated results through five polishing cycles were considered sufficient to demonstrate the usefulness of such other solutions.

All examples used the identical apparatus 20, and the wafers were removably mounted to the carrier 30 having the sheet 46 of FP-5G composition purchased from George Newman and Company. The polishing operations on the mounted wafers 40 were substantially identical, using a 5% dispersion in demineralized water of microfine precipitated silicon, sold by Philadelphia Quartz Company under the trade designation of QUSO-G32. All acids were of a reagent grade or of American Chemical Society Specifications.

As in the already described examples using 2 to 30% concentrations of acetic acid, the sheet 46 was treated by placing the carrier into the tray with the sheet 46 contacting a lint-free paper which had been soaked in the respective acid of the desired concentration.

After the sheet 46 had been treated with the respective acid solutions and before loading the wafers 40, the surface 49 of the sheet 46 was scraped with the steel blade until all excess of the acid solution was removed from the surface 49. The scraping of the surface 49 in the following additional examples was the same as that in the preferred examples.

FIG. 3 shows a flow diagram which sets forth the sequence used in mounting the wafers in accordance with the present invention. Using these common elements the following examples further explain the practice of the invention:

Additional Example No. 1

Reagent grade citric acid was diluted with water to form a 5% concentration by volume of citric acid. Polishing time varied from 15–20 minutes to remove approximately 0.001 inches of silicon. During the first cycle two wafers 40 broke because of what was believed to be wafer defects. The two wafers had not moved with respect to the carrier 30, however, and further polishing cycles were made using the same mounting sheet without a recurrence of such breakage.

Wafer retention was as good as that found with 2–30% acetic acid. Retention remained dependable through 5 cycles when the test was pronounced favorable and the run was discontinued. Polishing results were well within specification limits. The acid environment was odorless and nonhazardous.

Additional Example No. 2

Reagent grade propionic acid was diluted with water to form a 5% concentration by volume of propionic acid. Polishing time varied from 15–20 minutes to remove approximately 0.001 inches of silicon. Wafer retention was as good as that found with 2–30% acetic acid. Retention remained dependable through 5 cycles when the test was pronouced favorable and the run was discontinued. Polishing results were well within specification limits. The acid environment was slightly pungent but easily tolerable, much like that caused by 5% acetic acid. Hazards associated with using the dilute acid were minimal.

Additional Example No. 3

ACS grade formic acid was diluted with water to form a 5.91% concentration by weight of formic acid. Polishing time varied from 15–20 minutes to remove approximately 0.001 inches of silicon. Wafer retention was a good as that found with 2–30% acetic acid. Retention remained dependable through the 3rd cycle when the sheet 46 delaminated in the base matrix 47 and the surface layer 48 separated. The delamination caused a wafer 40 to be nonuniformly supported and wafer damage was experienced. Except for damage to the one wafer, the flatness on the other wafers on the carrier 30 were well within specification. In spite of the local delamination of the sheet 46 the improved holding force because of the treatment of the surface layer 48 was experienced. Furthermore, the carrier 30 need not be of the structure in which the sheet 46 is laminated to the flat surface of the carrier 30. The microcellular surface layer 48 of polyurethane is for instance suitably formed on a substantially hard, flat polyurethane base which may centrally hold the center hub 32 for mounting such alternately constructed carrier to the spindle 28.

The alternate construction of the carrier 30 may be only one example by which to avoid a delamination of the sheet 46. In general, the acids used for treatment of the surface layer 48 should, of course, be chosen from those known not to destroy the sheet 46. In the event that one of the acids is known to attack the polyurethane material or the sheet 46 when it is used thereon at any given concentration, a more dilute concentration will generally avoid or minimize such deleterious attack to permit the advantageous treatment of the surface layer 48 for the useful life of the surface layer 48.

Practical embodiments of the present invention have been described and illustrated herein. Yet it is to be understood that various modifications and refinements may be used which digress from these disclosed embodiments without departing from the spirit and scope of the present invention.

What is claimed is:

1. A method of removably mounting at least one planar article on a microcellular polyurethane surface for polishing such article, comprising:

treating the surface with an organic acid selected from the group consisting of citric, propionic, formic, and acetic acid to promote adhesion of the article to the surface by activating the surface; and positioning the planar article on the activated surface such that the article becomes adhered to such surface sufficiently to retain the article securely against lateral, shear forces experienced during polishing the article.

2. A method as in claim 3, wherein treating the surface comprises:

exposing the surface to an aqueous solution of an organic acid selected from the group consisting of citric, propionic, formic and acetic acids, to activate the surface; and scraping the exposed surface to further activate the surface and to substantially remove excess solution from the surface while leaving the surface wet.

3. A method as in claim 1, wherein positioning the article includes manually placing the article onto the activated and still wet surface.

4. A method as in claim 1, wherein the organic acid is an aqueous solution of acetic acid having a concentration of from about 2 to about 30 percent by weight of acetic acid.

5. A method as in claim 2, wherein the mounting surface is the top side of a composite sheet which includes a relatively hard but flexible, microcellular, polyurethane foam surface layer and a base matrix of polyester fibers bonded to the foam with polyurethane resin.

6. A method as in claim 5, wherein the organic acid is a aqueous solution of acetic acid having a concentration in a range between 2 and 30 percent by weight of acetic acid.

7. A method as in claim 2, wherein the planar article is a wafer to be used for making semiconductor devices, further comprising:

polishing the wafer; and demounting the wafer from the surface by applying a force to the wafer in a direction normal to and away from the surface.

8. A method of removably mounting silicon wafers on a microcellular, polyurethane foam sheet having a relatively hard, but flexible surface for polishing such wafers comprising:

bonding the sheet to a wafer carrier, the hard surface of the sheet being exposed for mounting wafers;

treating the exposed surface of the sheet with an aqueous solution of an organic acid selected from the group consisting of citric, propionic, formic, and acetic acid to promote adhesion of the article to the surface by activating the surface;

scraping the treated surface of the sheet to further activate the surface and to substantially remove any excess solution from the surface;

positioning the wafers on the treated surface such that the wafers become adhered to such surface sufficiently to retain the wafers securely against lateral, shear forces experienced during polishing the wafers;

polishing the wafers, the wafers remaining positioned on the mounting sheet; and demounting the wafers from the sheet by applying a force to the wafers in a direction normal to and away from the sheet.

9. A method as in claim 8, wherein the sheet is a composite of microcellular, polyurethane foam on the side to be activated and includes a matrix of polyester fibers bonded to the foam with polyurethane resin on the side to be bonded to the wafer carrier.

10. A method as in claim 8, wherein the organic acid is an aqueous solution of acetic acid having a concentration of from about 2 to about 30 percent by weight of acetic acid.

11. A method as in claim 10, wherein the treating step includes:

soaking lint-free paper in the acid solution to wet the paper; and placing the exposed surface of the sheet, after it has been bonded to the carrier, upon the paper for from about 1 to about 6 minutes.

12. A method according to claim 9, wherein:

the acid solution is diluted with water sufficiently to extend the useful life of the microcellular, polyurethane foam sheet to at least five polishing cycles while retaining enough acid concentration in the solution to activate the exposed surface of the sheet.

* * * * *

UNITED STATES PATENT AND TRADEMARK OFFICE

CERTIFICATE OF CORRECTION

PATENT NO. : 4,239,567

DATED : December 16, 1980

INVENTOR(S) : Richard Harold Winings

It is certified that error appears in the above-identified patent and that said Letters Patent are hereby corrected as shown below:

Column 6, Line 42, "silicon" should be --silica--.

Column 7, Line 33, "a good as" should be --as good as--.

Column 8, Line 13, Claim 2, "Claim 3" should be --Claim 1--.

Column 8, Line 34, Claim 6, "a aqueous" should be --an aqueous--.

Signed and Sealed this

*Fourteenth* Day of *April 1981*

[SEAL]

*Attest:*

RENE D. TEGTMEYER

*Attesting Officer*

*Acting Commissioner of Patents and Trademarks*